US009841184B2

(12) United States Patent
Kreider et al.

(10) Patent No.: US 9,841,184 B2
(45) Date of Patent: Dec. 12, 2017

(54) METHOD AND APPARATUS FOR EVALUATING REPAIR AND REMEDIATION ALTERNATIVES FOR HEAT EXCHANGERS

(75) Inventors: Marc A. Kreider, Herndon, VA (US); Robert D. Varrin, Jr., Reston, VA (US); Glenn A. White, Falls Church, VA (US); Velvet D. Moroney, Manassas Park, VA (US)

(73) Assignee: Dominion Engineering, Inc., Reston, VA (US)

( * ) Notice: Subject to any disclaimer, the term of this patent is extended or adjusted under 35 U.S.C. 154(b) by 1397 days.

(21) Appl. No.: 13/580,334

(22) PCT Filed: Feb. 25, 2011

(86) PCT No.: PCT/US2011/026334

§ 371 (c)(1),
(2), (4) Date: Aug. 21, 2012

(87) PCT Pub. No.: WO2011/106712

PCT Pub. Date: Sep. 1, 2011

(65) Prior Publication Data

US 2012/0330474 A1 Dec. 27, 2012

Related U.S. Application Data

(60) Provisional application No. 61/308,500, filed on Feb. 26, 2010.

(51) Int. Cl.
*G06F 17/18* (2006.01)
*G06F 1/28* (2006.01)
(Continued)

(52) U.S. Cl.
CPC ..... *F22B 35/18* (2013.01); *F22B 35/004* (2013.01); *F22B 37/003* (2013.01); *F28G 15/003* (2013.01)

(58) Field of Classification Search
CPC ..... G06Q 10/00; G06Q 10/063; G06Q 10/06375; G06Q 10/0635; G05B 13/024;
(Continued)

(56) References Cited

U.S. PATENT DOCUMENTS 6,195,624 B1 * 2/2001 Woodman ..... G06F 17/5009 702/34
6,529,849 B2 * 3/2003 Umezawa ..... G05B 23/024 60/39.182
(Continued)

FOREIGN PATENT DOCUMENTS

| | | |
|---|---|---|
| EP | 0 205 764 | 12/1986 |
| EP | 1 435 435 | 7/2004 |
| WO | WO 2007/149190 | 12/2007 |

OTHER PUBLICATIONS

Odar, S., et al., "Cleanliness Criteria to Improve Steam Generator Performance," paper presented at the International Conference on Water Chemistry of Nuclear Reactor Systems 2006 held at Jeju Island, Korea, Oct. 23-26, 2006.
(Continued)

*Primary Examiner* — Jeffrey Aiello
(74) *Attorney, Agent, or Firm* — Pillsbury Winthrop Shaw Pittman LLP

(57) ABSTRACT

A method is provided for evaluating simultaneously the effects of multiple, interdependent heat-exchanger degradation modes for a heat exchanger of a power plant in the context of a series of alternative heat-exchanger remediation strategies. The method includes calculating time-varying predicted future progressions of heat exchanger performance metrics for a plurality of alternative heat-exchanger remediation strategies, and calculating time-varying predicted future progressions of financial metrics describing the accumulated financial benefit of each of the strategies. The calculations may be provided in probabilistic terms. A
(Continued)

strategy may then be chosen based, at least in part, on the calculated results.

25 Claims, 4 Drawing Sheets

(51) Int. Cl.
*F22B 35/18* (2006.01)
*F22B 35/00* (2006.01)
*F22B 37/00* (2006.01)
*F28G 15/00* (2006.01)

(58) Field of Classification Search
CPC ..... F01K 13/02; F28F 19/00; F28F 19/06; F28D 7/16; F22B 35/004
USPC ..... 60/39.182; 702/34, 181, 182; 705/7.28, 705/7.37; 165/95
See application file for complete search history.

(56) References Cited

U.S. PATENT DOCUMENTS 6,740,168 B2 5/2004 Rootham et al.
6,944,254 B2 * 9/2005 Kormuth ..... G21C 19/307 252/625
7,344,602 B2 3/2008 Varrin et al.
7,637,653 B2 * 12/2009 Pop ..... F22B 37/002 374/7
7,801,660 B2 * 9/2010 Zhang ..... F04D 27/02 415/13
7,810,991 B2 10/2010 Pop et al.
8,050,874 B2 * 11/2011 Papadimitriou ... G01N 27/9046 702/34
2001/0034582 A1 * 10/2001 Umezawa ..... G05B 23/024 702/136
2007/0181082 A1 8/2007 Barkich
2008/0288198 A1 11/2008 Francino et al.
2009/0292574 A1 * 11/2009 Pop ..... F22B 37/002 705/7.37
2010/0306001 A1 * 12/2010 Discenzo ..... G05B 13/024 705/7.37
2011/0005225 A1 * 1/2011 Namba ..... F01K 17/005 60/645
2011/0046997 A1 * 2/2011 Noureldin ..... F01K 13/02 705/7.12
2011/0046998 A1 * 2/2011 Noureldin ..... F01K 13/02 705/7.37
2011/0054715 A1 * 3/2011 Noureldin ..... F01K 13/02 700/300
2011/0066298 A1 * 3/2011 Francino ..... F01K 9/003 700/290
2011/0087517 A1 * 4/2011 Abbott ..... G05B 23/0283 705/7.28
2011/0283704 A1 * 11/2011 Hatamiya ..... F01K 7/38 60/670
2012/0041608 A1 * 2/2012 Zugibe ..... G06F 17/5068 700/285
2012/0095574 A1 * 4/2012 Greenlee ..... G05B 23/0245 700/30
2012/0316916 A1 * 12/2012 Andrews ..... G06Q 40/08 705/7.28
2013/0060487 A1 * 3/2013 Papadimitriou ..... G10L 15/22 702/34

OTHER PUBLICATIONS

Kreider, M. A., et al., "Effects of Secondary Deposits on SG Thermal Performance: 1999 Industry Experience Update," in *Proceedings: Steam Generator Sludge Management Workshop*, EPRI No. TR-114854, p. 12-1 ff. Palo Alto, CA: Electric Power Research Institute, 2000 (held in Scottsdale, AZ, Sep.-Oct. 1999).
Kreider, M. A., et al., "Economic Evaluation of SG Secondary Management Strategies at Plant Vogtle," in *Proceedings: 2003 Steam Generator Secondary Side Management Conference*, EPRI No. 1008468, pp. 766-818. Palo Alto, CA: Electric Power Research Institute, 2003 (held in Savannah, GA, Feb. 2003).
International Search Report as issued for International Application No. PCT/US2011/026334, dated Jul. 2, 2012.
International Preliminary Report on Patentability, including the Written Opinion, as issued for International Application No. PCT/US2011/026334, dated Sep. 7, 2012.

* cited by examiner

METHOD AND APPARATUS FOR EVALUATING REPAIR AND REMEDIATION ALTERNATIVES FOR HEAT EXCHANGERS

CROSS REFERENCE

This application is the U.S. National Stage of PCT/US2011/026334, filed Feb. 25, 2011, which in turn claims the benefit of priority from U.S. Provisional Patent Application No. 61/308,500, filed Feb. 26, 2010, titled "Method for Evaluating Repair and Remediation Alternatives for Large Heat Exchangers," the entire contents of which are hereby incorporated by reference herein.

BACKGROUND

This invention relates to a method for analyzing the consequences (both relative to economics and relative to plant metrics) of employing different alternative strategies for managing the operation of large heat exchangers, e.g., those with more than about 10,000 square feet (900 square meters) of heat transfer surface area. Heat exchangers serve as a device for transferring heat from one medium to another.

Large heat exchangers such as recirculating nuclear steam generators typically comprise the following major components: a) an outer (typically vertically oriented) shell, b) a plurality of tubes, which are often disposed in an inverted U configuration, that collectively form a tube bundle located within the outer shell, c) a cylindrical plate known as the wrapper which is located between the outer shell and the tube bundle and serves to direct incoming liquid flowing into the steam generator, d) a thick plate known as the tubesheet which is connected on one side to, and penetrated by, each of the tubes in the tube bundle and separates an upper secondary side of the heat exchanger from a lower primary side of the heat exchanger, e) a plurality of thinner plates spaced periodically along the lengths of the inverted U-tubes, known as tube support plates, that provide structural support to the inverted U-tubes during operation of the steam generator, f) a divided chamber known as the primary channel head which is attached to the other side of the tube sheet and contains both an entrance plenum and an exit plenum that are in communication through the plurality of inverted U-tubes, g) moisture separation components located above the tube bundle that might include cyclone separator units, hook-and-vane dryers, or other components that separate liquid from steam, and h) a steam outlet nozzle from which steam produced within the steam generator exits the steam generator. Some steam generators also contain: i) a sub-assembly of pipes arranged in a circle located above the tube bundle and known as the feedring which is used to inject liquid water into the steam generator, and/or j) a sub-assembly of plates arranged within the tube bundle, which are known collectively as a preheater or economizer, into which liquid water enters the steam generator.

The basic functioning of a recirculating nuclear steam generator involves heating of a secondary fluid by a primary fluid. The primary fluid's path through the steam generator is described by the following sequence: 1) primary fluid is heated by circulation through the core of the nuclear reactor and then enters the steam generator through the entrance plenum in the primary channel head, 2) this primary fluid then enters the insides of the inverted U-shaped tubes at the lower (primary) face of the tube sheet, to which the inverted U-tubes are attached, 3) the primary fluid is carried through the full length of inverted U-tubes, heating the U-tubes and, through the heated tubes, the secondary fluid present on the outside of the U-tubes, 4) the primary fluid exits the U-tubes through the tube sheet into the exit plenum of the primary channel head, and 5) the primary fluid exits the steam generator through an outlet nozzle in the primary channel head, after which it is returned to the nuclear reactor for reheating.

The secondary fluid's path through the recirculating steam generator is typically described by the following sequence: 1) secondary fluid enters the steam generator as a liquid through an injection nozzle into a feedring above the tube bundle or, alternatively, directly into the preheater, 2) the secondary fluid then either enters the annular space (known as the downcomer) between the outer shell and the wrapper or, alternatively, proceeds through the preheater, 3) the secondary fluid exits the downcomer or the preheater at or near the upper surface of the tube sheet, 4) the secondary fluid then flows upward through the tube bundle, in contact with the outsides of the inverted U-tubes where it is heated by the U-tubes, 5) during its upward journey, the secondary fluid boils to produce a two-phase mixture of steam and liquid water, and 6) after exiting the tube bundle at the top, the secondary fluid enters moisture separation equipment which segregates the secondary fluid into its liquid component, which is recycled into the downcomer, and its steam component, which exits the steam generator through an outlet nozzle disposed at the uppermost end of the outer shell. The steam portion of the secondary fluid passes through standard electrical generating equipment, including turbines and a condenser, before returning to the steam generator in liquid form for reheating.

Large heat exchangers other than recirculating nuclear steam generators may have different basic components and component arrangements than those described in the above paragraphs (e.g., helical, plate-frame, and compact heat-exchanger designs such as printed-circuit heat exchangers in gas-cooled reactors). Similarly, the descriptions of degradation modes in the paragraphs below are particular to recirculating nuclear steam generators. However, the application of the invention is not limited to these heat exchangers or the particular degradation modes described.

Normal operation of nuclear plants leads to the flow of large masses of secondary fluid through the recirculating nuclear steam generator tube bundles (typically on the order of several million pounds of water per hour per steam generator). Inevitably, small concentrations of impurities such as iron oxide and copper originating from metallic plant components exterior to the steam generators contaminate the secondary fluid. Although these impurities are present in very small concentrations (on the order of one part per billion), the large flow rates of secondary fluid through the steam generator ensure that significant quantities (on the order of one hundred pounds or more) of impurities enter each operating steam generator during each year of operation. The majority (in excess of 50% and often more than 90%) of these impurities deposit within the steam generator, with the largest fraction thereof depositing as scale layers on the exterior surfaces of the inverted U-tubes and a typically smaller fraction settling on the top of the tube sheet surface where it often consolidates into a hardened "sludge pile". The tube-surface deposits can after a period of time lead to a decrease in the heat-transfer efficiency of the steam generator, a process known as tube deposit heat-transfer fouling. This fouling generally reduces the thermal efficiency of the entire plant, lowering the electrical power which is produced. In some cases, the reduction in plant output can be substantial (several percent or more) unless remedial actions are taken.

In addition to deposit heat-transfer fouling, most nuclear steam generators in operation are susceptible to service-induced corrosion and wear of the inverted U-tubes through a number of distinct mechanisms. The corrosion mechanisms can initiate on the inner (primary) tube surface or on the outer (secondary) tube surface. Corrosion that initiates on the outer tube surfaces has been shown in some circumstances to be exacerbated by the presence of deposits on tube surfaces and deposits within crevices formed by the U-tubes at the locations where they pass through the tube sheet and tube support plates. Because the U-tubes serve as a structural boundary between the primary fluid, which circulates through the reactor, and the secondary fluid, most types of corrosion require that the affected tubes be repaired (e.g., through installation of a protective sleeve attached to the inside surface of the tube that permits the tube to remain in service) or removed from service (e.g., through plugging of each end, preventing flow of primary fluid through the tube) as soon as such corrosion is detected through routine inspection methods. Removal of tubes lowers the heat-transfer capability of the steam generator, reducing plant output in a way analogous to that associated with tube deposit heat-transfer fouling. Typically, steam generators with susceptible tubing will experience corrosion of an increasing fraction of the tube bundle as operating time accumulates. Eventually, if a sufficient number of tubes is removed from service, the steam generator must be entirely replaced to permit continued plant operation.

In a nuclear steam generator, each tube support plate typically contains an array of holes therein for accommodating passage of the U-shaped tubes through the tube support plates. The height of the U-shaped tubes may exceed 30 feet (9 m), and a steam generator therefore typically includes six or more tube support plates, each horizontally disposed along the vertically oriented tube path, with adjacent tube support plates typically having a vertical separation of 3 to 5 feet (0.9 to 1.5 m). Tube support plates may comprise solid metallic plates with machined openings that may be circular in shape ("drilled holes") or lobed in shape ("broached holes" with three lobes ("trefoil" design) or four lobes ("quatrefoil" design) being common). In other designs, the tube support plates may comprise interlocking arrangements of steel bars known as lattice bars.

For tube support plates with drilled holes, the inverted U-tubes pass through some of the circular holes within the tube support plates while secondary fluid passes through other such circular holes. Thus, the large majority of the secondary fluid does not pass through the circular holes through which the U-tubes pass. In contrast, for tube support plates with broached holes, the secondary fluid passes through the lobes and therefore comes into contact with the heated tubes while it is passing through the tube support plates. In a number of cases, steam generators with broached hole tube support plates have experienced service-induced blockages of the lobes through which the secondary fluid passes during operation of the steam generator. These blockages occur as a result of deposition of corrosion products that are suspended and/or dissolved within the secondary fluid onto the lobe surfaces. In severe cases, many lobes can become fully blocked, admitting no secondary fluid flow and causing controllability problems that require the plant power level to be decreased or the plant to be shut down until the blocking deposits can be partially or fully removed.

SUMMARY OF EMBODIMENTS OF THE INVENTION

One or more embodiments of this method involve the application of probabilistic techniques to simultaneously evaluate the effects of numerous disparate—but in some cases interdependent—degrading phenomena that compromise the heat exchangers' ability to continue to operate, either at full efficiency or at all. Application of one or more embodiments of the invention yields: a) probabilistic projections in time of the progressions of many or all key degradation modes, including those which exhibit interdependence, and b) probabilistic projections in time of the economic consequences of alternative repair and remediation strategies that incorporate options for simultaneously addressing numerous disparate degradation modes, including those which are interdependent.

In one or more embodiments, the heat exchanger is a recirculating nuclear steam generator. However, one or more embodiments of the invention can be applied to any other type of heat exchanger (including, e.g., those of the shell-and-tube, plate frame, and compact designs) that is subject to one or more degradation modes such as decreased heat-transfer efficiency caused by fouling deposits, corrosion of heat-exchanger components requiring repair, mechanical damage such as that due to vibration and fretting wear, etc. The heat exchanger may be a heat exchanger of a power plant (e.g., an electrical power plant) such as a land-based or ship-based, commercial or non-commercial (e.g., military, government), fossil fuel or nuclear power plant (e.g., commercial, land-based, fossil-fuel electric power plant; commercial, land-based nuclear electric power plant; nuclear powered submarine; nuclear powered ship). Alternatively, the heat exchanger may be a heat exchanger used in a context outside of power plants (e.g., chemical plants).

During the last 25 years, numerous techniques have been developed to partially or fully remove the deposits that form on the secondary side of steam generators. These include, among others: a) partial-height or full-height chemical cleaning, b) top-of-tube-sheet mechanical lancing, c) upper- or in-bundle mechanical lancing (e.g., CECIL™) and upper-bundle hydraulic cleaning), d) upper-bundle or top-of-bundle water flushes, e) dilute chemical treatments (e.g., advanced scale conditioning agents (e.g., U.S. Pat. Nos. 6,740,168 and 7,344,602)), f) ultrasonic energy cleaning, and g) application of polymeric dispersant to reduce the fraction of impurities that deposit within the steam generator. Application of each method involves different combinations of vendor cost, plant resources such as engineering and craft labor, necessary extension to planned plant outage duration, risk of adverse side effects, and degree of success in removing deposits from one or more regions of the steam generator. Thus, the total cost and the ultimate success in remedying tube deposit heat-transfer fouling, deposit-exacerbated tube corrosion, and deposit-induced broached-hole blockage vary substantially with the method chosen and the time of application(s) of the method(s).

Typical moisture separation equipment in nuclear steam generators comprises a plurality of primary separator units into which the two-phase boiling secondary fluid enters from the tube bundle. Typically, the two-phase secondary fluid has a quality (i.e., percentage which is vapor or steam) of between about 20% and about 40%. The primary separator units are typically circular in cross section and rely upon rotational motion of the two-phase mixture within the primary separator units to achieve separation of the liquid droplets—which impact the sides of each primary separator unit and drain out of the bottom of these units under the influence of gravity—from the remaining steam, which rises through an exit in the top of the primary separator units. Upon exiting the primary separator units, the steam, which still contains some liquid (on the order of 1% by mass), passes through a plurality of secondary separation units to further segregate the steam from the liquid. These secondary separation units may also rely on rotational motion or may involve other tortuous paths to achieve this separation. In some cases, due to the effects of the two-phase flow, the separator units in some nuclear steam generators have experienced material degradation that threatens the integrity of the components. If severe enough, such degradation can require repairs to the affected separator units to remedy the defects or complete replacement of the separator units to permit continued steam generator (and plant) operation.

Preceding one or more embodiments of the current invention, decisions on whether (and how and when) to remediate steam generator degradation modes such as tube deposit heat-transfer fouling, tube corrosion, and broached hole tube support plate blockage through partial or total removal of corrosion deposits have been made using, among others, the following criteria and/or approaches: a) remove tube deposits (e.g., through chemical cleaning) when the estimated total mass of deposits present on all tube surfaces reaches a threshold value, b) remove tube deposits when a fouling index reaches a predetermined threshold value (e.g., per Odar et al. (Odar, S., V. Schneider, T. Schwarz, R. Bouecke, "Cleanliness Criteria to Improve Steam Generator Performance," paper presented at the International Conference on Water Chemistry of Nuclear Reactor Systems 2006 held at Jeju Island, Korea, Oct. 23-26, 2006) or per U.S. Patent Application Publication No. 2007/0181082), c) remove deposits (e.g., from the top of the tube sheet) according to a preestablished cleaning schedule consistent with avoiding "excessive" deposit buildup in certain regions within the steam generator, d) remove tube deposits in order to reduce the perceived risk that the steam generators will require replacement prior to the end of the plant's license period (e.g., due to increasing tube-corrosion-induced tube plugging) to an acceptable (albeit unquantified) level, and e) remove tube deposits prior to, or upon, the incidence of heat-transfer-fouling-induced reductions in plant output. The above criteria and approaches have been commonly employed in past years. However, beginning primarily in the 1990s and continuing to today, many electric utilities are facing an increasingly deregulated economic environment and are therefore under increasing pressures to demonstrate that the costs of deposit removal applications are balanced or outweighed by the economic benefits.

To address this need, in recent years another approach, f), has been developed. This approach includes determining the heat-exchanger repair and remediation alternative strategy which results in the smallest total net present value (NPV) cost, incurred during some time period, among a series of alternatives considered, where this total NPV cost includes the costs of implementing the alternative strategy and the costs of lost plant production through reduced plant output and/or extended plant outage time and where said lost plant production is the result of heat-transfer fouling and/or corrosion-induced tube repairs. The alternative strategy implementation cost includes the costs associated with deposit removal (if any), tube inspection and repair, and other heat-exchanger remediation activities (e.g., moisture separator component repair etc.). The approach is documented in Kreider et al.'s 1999 nuclear industry presentation in Scottsdale (Kreider, M. A., G. A. White, and R. D. Varrin, Jr., "Effects of Secondary Deposits on SG Thermal Performance: 1999 Industry Experience Update," in *Proceedings: Steam Generator Sludge Management Workshop*, EPRI No. TR-114854, p. 12-1 ff. Palo Alto, Calif.: Electric Power Research Institute, 2000 (held in Scottsdale, Ariz., September-October 1999) (Kreider et al. (1999))) and also, in more detail, in Kreider et al.'s 2003 industry presentation in Savannah (Kreider, M. A., G. A. White, R. D. Varrin, Jr., and F. D. Hundley, "Economic Evaluation of SG Secondary Management Strategies at Plant Vogtle," in *Proceedings:* 2003 *Steam Generator Secondary Side Management Conference*, EPRI No. 1008468, pp. 766-818. Palo Alto, Calif.: Electric Power Research Institute, 2003 (held in Savannah, Ga., February 2003) (Kreider et al. (2003))). More recently, Pop et al.'s U.S. Pat. Nos. 7,637,653 and 7,810,991 disclose an approach implemented with a specific, prescribed set of functional relationships among certain tube deposit properties and the steam generator heat-transfer efficiency.

The approaches for evaluating the economics of deposit management alternatives described in Kreider et al. (1999), Kreider et al. (2003), and Pop et al.'s U.S. Pat. No. 7,637,653 are based on deterministic calculations—that is, calculations that employ input values that are specified without the influence of any random uncertainties. The most important of these deterministic calculations employ "best-estimate" values for the calculation inputs, i.e., the values considered the most likely to be representative of the actual input values (in cases where such inputs are not definitively known). Kreider et al. (2003) discusses the use of "carefully chosen bounding cases" to ensure that "the input sensitivities/uncertainties are appropriately considered." However, evaluation of these bounding cases, like the best-estimate evaluations, reflects deterministic calculations. In Pop et al.'s U.S. Pat. No. 7,637,653, no mention is made of input uncertainties (though Pop et al's U.S. Pat. No. 7,637,653 uses tolerances as constraints to arrive at a deterministic solution per Pop, M. G., P. Shoemaker, K. Colgan, and J. Griffith, "Steam Generator Asset Management Model Application," in Proceedings of ICAPP 2008, Paper No. 8416, pp. 911-917. La Grange Park, Ill.: American Nuclear Society (held in Anaheim, Calif., Jun. 8-12, 2008)).

In addition to alternatives for removing secondary corrosion product deposits, utilities must also choose from among other alternatives for operating steam generators that can affect steam generator operability, plant production level, plant availability, and total NPV cost. These alternatives include, among others: a) the choice for the value of the operating temperature of the primary fluid as it enters the steam generator entrance plenum, b) the strategy for repairing defective U-shaped tubes in the steam generators, which can include plugging (which takes the tubes out of service) and sleeving (which is more costly and time consuming but which allows the tubes to remain in service), c) the strategy for addressing material degradation of moisture separator components, which might include component repair or component replacement at a chosen time, d) whether or not to implement a plant thermal power uprate and, if so, when to do so and how large an uprate to implement, and e) whether and, if so, when to implement steam generator replacement. The method in Kreider et al. (2003) incorporates some of these decisions (e.g., primary fluid temperature choice and steam generator replacement strategy) using deterministic calculations.

One objective of one or more embodiments of the invention is an integrated probabilistic evaluation method capable of simultaneous evaluation of the effects of multiple interdependent heat-exchanger degradation modes, in the context of alternative strategies comprising options related to one or more of the degradation modes, on: a) the time-varying progressions of important plant metrics such as secondary heat-exchanger pressure, plant electrical production, and the fraction of defective heat-exchanger tubes, among others; and b) the time-varying economic costs associated with alternative strategies for remedying one or more of these heat-exchanger degradation modes. Further, one or more embodiments of this evaluation tool are capable of assessing the effects of both systematic and random uncertainty in multiple analysis inputs on the calculated results through the use of probabilistic methods for arbitrary probabilities of occurrence of particular outcomes.

One advantage of one or more embodiments of the invention include: 1) the combined effects of the degradation modes, including the effects of statistically distributed uncertainties incorporated therein, may be simultaneously evaluated quantitatively to yield families of optimistic and pessimistic results with quantified probabilities of occurrence; and 2) the probabilities of specific outcomes related to the relative costs of alternative strategies or related to the progression of important plant metrics may be directly calculated. In contrast, the investigations of uncertainty with conventional deterministic methods are typically very limited compared to one or more embodiments of the current invention due to the impracticality of selecting, completing, and analyzing very large numbers of bounding calculations. Consider the following example, in which one heat-exchanger owner may wish to examine all combinations of the following repair and remediation options: three primary fluid temperatures, 10 deposit-removal options, four tube repair options, two thermal power options, and 20 different heat-exchanger replacement dates. In this situation, 4,800 different sets of analyses must be completed. Evaluating the combined effects of uncertainty in the important calculation inputs, which themselves may number in the dozens, thus could require many thousands or even millions of distinct sets of calculations in which an iterative process may need to be used to determine the appropriate bounding values for the important inputs in order to discern the important effects of the combined uncertainties. In contrast, with one or more embodiments of the current invention, the probabilistic approach according to one or more embodiments of the present invention ensures that any arbitrary probability of occurrence for calculation results may be generated practically.

One feature associated with Item "1" is that calculated "best-estimate" results computed with one or more embodiments of the current invention may be more realistic and accurate than those calculated with deterministic methods because the effects of asymmetric uncertainties are appropriately accounted for with one or more embodiments of the current invention.

A second feature associated with Item "1" is that, through the use of the probabilistic approach inherent in one or more embodiments of the current invention, the contributions of unlikely events (such as, for example, severe blockage of the tube support plate broached holes due to deposit buildup) to the cost of operating the heat exchangers may be accounted for quantitatively in a fashion consistent with the predicted probability of the unlikely event. Specifically, such quantitative accounting can be achieved for predicted total costs with a range of probabilities of occurrence.

An advantage of Item "2", relative to prior art, according to one or more embodiments of the present invention, stems in part from the fact that the owner of the heat-exchanger is able to use quantitative estimates of specific outcomes as part of its decision-making process. For example, consider the following situation. One heat-exchanger remediation strategy alternative may result in a median predicted cost which is smaller than the median cost predicted for a second strategy alternative. However, in this example, the first strategy may also result in a predicted probability of 25% that the plant thermal power level will decrease during future operation, compared to a predicted 5% probability for the second strategy. With one or more embodiments of the current invention, the owner can weigh this quantitative information about the risk of future power reductions in his decision-making process. One or more embodiments of the current invention can provide similar quantitative information about the probabilities of other events of interest to the owner of the heat exchanger, e.g., the probability that tube repairs will exceed a certain threshold, the probability that plant output reductions will exceed a certain value, the probability that broached hole tube support plate blockage will result in thermal power reductions or a plant outage, the probability that a specific deposit removal/remediation application will allow the plant to avoid thermal power reductions during a specified time period, etc.

One or more embodiments of the current invention may be embodied through the implementation of an algorithm for calculating, with probabilistic methods, important plant metrics (e.g., steam generator steam pressure, plant output (MWe), etc.) and total NPV costs for heat-exchanger remediation strategies, including the escalation of one or more individual cost components, such as vendor costs, plant labor costs, etc., during future time periods. The implementation of such a probabilistic algorithm is efficiently carried out through development of a suitable computer code.

One or more embodiments provide a method for evaluating simultaneously the effects of multiple, interdependent heat-exchanger degradation modes for a heat exchanger of a power plant in the context of a series of alternative heat-exchanger remediation strategies that include individual options for remedying one or more of the degradation modes. The method includes receiving and/or calculating probabilistic time-varying predicted future progressions of heat exchanger performance metrics for a plurality of alternative heat-exchanger remediation strategies. The performance metrics include: a secondary side operating pressure of the heat exchanger, a heat-transfer efficiency of the heat exchanger, a fraction of defective components within the heat exchanger that are subject to one or more heat-exchanger degradation modes, and an electrical power output of the plant. The method also includes receiving and/or calculating probabilistic time-varying predicted future progressions of financial metrics describing the accumulated financial benefit of each of the plurality of alternative heat-exchanger remediation strategies. The time-varying predicted future progressions of heat-exchanger performance metrics for a plurality of alternative heat-exchanger remediation strategies account for routine post-outage heat-transfer transients that result from operating the plant in accordance with each of the plurality of alternative heat-exchanger remediation strategies. For example, a utility that operates a power plant may undertake the calculations itself, in which case the utility receives the future progressions as a result of its own calculations. Alternatively, a third party may perform the calculations and deliver the results to the utility such that the utility receives the progressions/results from the third party.

One or embodiments provide a computer-implemented method of conducting the above-discussed method(s), the method being implemented in a computer including electronic storage and one or more physical processors configured to execute one or more computer program modules.

One or more embodiments provide a computer-readable storage medium tangibly embodying computer-executable instructions for carrying out the above-discussed method(s). Executing the computer-executable instructions on a processor causes the processor to perform one or more of the above-discussed methods.

According to one or more of these embodiments, one of the plurality of alternative heat-exchanger remediation strategies includes a modification of a valve of a high-pressure turbine of the power plant (e.g., turbine throttle valve and/or governor valve), wherein the turbine is operatively connected to the heat exchanger. Another of the plurality of alternative heat-exchanger remediation strategies does not include the modification of the valve.

According to one or more of these embodiments, one of the plurality of alternative heat-exchanger remediation strategies includes an implementation of a feedwater heater bypass configuration configuration. Another of the plurality of alternative heat-exchanger remediation strategies does not include an implementation of a feedwater heater bypass configuration configuration.

According to one or more of these embodiments, one of the plurality of alternative heat-exchanger remediation strategies includes a change to the chemistry of water in the secondary plant system (e.g., that system to which the shell side of the heat exchangers in the power plant belongs). Another of the plurality of alternative heat-exchanger remediation strategies does not include a change to the chemistry of water in the secondary plant system.

According to one or more of these embodiments, one of the plurality of alternative heat-exchanger remediation strategies includes a first change to the chemistry of water in a secondary plant system. Another of the plurality of alternative heat-exchanger remediation strategies includes a second change to chemistry of water in the secondary plant system, the second change differing from the first change.

According to one or more of these embodiments, one of the plurality of alternative heat-exchanger remediation strategies includes adding zinc to a primary coolant (e.g., the coolant associated with the tube side of the power plant heat exchangers) associated with the heat exchanger, and the time-varying predicted future progression of heat-exchanger performance metrics for the one of the plurality of alternative heat-exchanger remediation strategies accounts for one or more effects of an addition of zinc to the primary coolant.

According to one or more of these embodiments, the financial metrics account for forced outages and/or mid-cycle outages associated with the plurality of alternative heat-exchanger remediation strategies.

According to one or more of these embodiments, the method further includes selecting and implementing one of the plurality of alternative heat-exchanger remediation strategies based on (1) the received time-varying predicted future progressions of financial metrics and/or (2) the received time-varying predicted future progressions of the heat exchanger performance metrics.

According to one or more of these embodiments, at least one of the plurality of alternative heat-exchanger remediation strategies includes at least one of the following options: remedying tube deposit heat-transfer fouling, remedying heat-exchanger tube corrosion and wear degradation, remedying tube support plate broached hole blockage, remedying tube support plate material degradation, and remedying moisture separator component material degradation, respectively.

According to one or more of these embodiments, at least one of the plurality of alternative heat-exchanger remediation strategies includes at least one of the following options for remedying tube deposit heat-transfer fouling: full-height chemical cleaning at one or more specific times, full-height chemical cleaning at a different time than a full-height chemical cleaning according to a different one of the plurality of alternative heat-exchanger remediation strategies, partial-height chemical cleaning at a specific time, partial-height chemical cleaning at a different time than a partial-height chemical cleaning according to a different one of the plurality of alternative heat-exchanger remediation strategies, at least one dilute chemical application at at least one specific time and/or frequency, at least one dilute chemical application at a different time and/or frequency than at least one dilute chemical application according to a different one of the plurality of alternative heat-exchanger remediation strategies, tube sheet sludge lancing at at least one specific time and/or frequency, tube sheet sludge lancing at a different time and/or frequency than a time and/or frequency of at least one tube sheet sludge lancing according to a different one of the plurality of alternative heat-exchanger remediation strategies, in-bundle water-jet lancing at at least one specific time and/or frequency, in-bundle water-jet lancing at a different time and/or frequency than an in-bundle water-jet lancing according to a different one of the plurality of alternative heat-exchanger remediation strategies, tube bundle flushing at at least one specific time and/or frequency, tube bundle flushing at a different time and/or frequency than a tube bundle flushing according to a different one of the plurality of alternative heat-exchanger remediation strategies, ultrasonic energy cleaning at at least one specific time and/or frequency, ultrasonic energy cleaning at a different time and/or frequency than an ultrasonic energy cleaning according to a different one of the plurality of alternative heat-exchanger remediation strategies, polymeric dispersant addition, other secondary water chemistry changes, and combinations thereof.

According to one or more of these embodiments, at least one of the plurality of alternative heat-exchanger remediation strategies includes at least one of the following options for remedying heat-exchanger tube corrosion and wear degradation: repairing defective heat-exchanger tubes by plugging, repairing defective heat-exchanger tubes by sleeving, reducing the rate of future occurrence of degraded tubes by lowering the primary fluid temperature, implementing a full-height chemical cleaning at one or more specific times, implementing a full-height chemical cleaning at a specific time that is different than a specific time of a full-height chemical cleaning according to a different one of the plurality of alternative heat-exchanger remediation strategies, implementing a partial-height chemical cleaning at a specific time, implementing a partial-height chemical cleaning at a specific time that is different than a specific time of partial-height chemical cleaning according to a different one of the plurality of alternative heat-exchanger remediation strategies, and combinations thereof.

According to one or more of these embodiments, at least one of the plurality of alternative heat-exchanger remediation strategies includes at least one of the following options for remedying tube support plate broached hole blockage:

implementing a full-height chemical cleaning at one or more specific times, implementing a full-height chemical cleaning at a specific time that is different than a specific time of a full-height chemical cleaning according to a different one of the plurality of alternative heat-exchanger remediation strategies, implementing at least one dilute chemical application at at least one specific time and/or frequency, implementing at least one dilute chemical application at a different time and/or frequency than a dilute chemical application according to a different one of the plurality of alternative heat-exchanger remediation strategies, in-bundle water-jet lancing at at least one specific time and/or frequency, and in-bundle water jet lancing at a different time and/or frequency than an in-bundle water-jet lancing according to a different one of the plurality of alternative heat-exchanger remediation strategies.

According to one or more of these embodiments, at least one of the plurality of alternative heat-exchanger remediation strategies includes at least one of the following options for remedying tube support plate material degradation: implementing a full-height chemical cleaning at one or more specific times, implementing a full-height chemical cleaning at a specific time that is different than a specific time of a full-height chemical cleaning according to a different one of the plurality of alternative heat-exchanger remediation strategies, implementing a partial-height chemical cleaning at a specific time, implementing a partial-height chemical cleaning at a specific time that is different than a specific time of partial-height chemical cleaning according to a different one of the plurality of alternative heat-exchanger remediation strategies, implementing at least one dilute chemical application at at least one specific time and/or frequency, implementing at least one dilute chemical application at at least one specific time and/or frequency, wherein the at least one specific time and/or frequency is different than at least one specific time and/or frequency of at least one dilute chemical application according to a different one of the plurality of alternative heat-exchanger remediation strategies, in-bundle water jet lancing at at least one specific time and/or frequency, and in-bundle water-jet lancing at a different time and/or frequency than an in-bundle water-jet lancing according to a different one of the plurality of alternative heat-exchanger remediation strategies.

According to one or more of these embodiments, at least one of the plurality of alternative heat-exchanger remediation strategies includes at least one of the following options for remedying tube moisture separator component material degradation: weld repairs, separator component replacement, at least one chemical cleaning at a different time and/or frequency than a chemical cleaning according to a different one of the plurality of alternative heat-exchanger remediation strategies, and at least one in-bundle water-jet lancing at a different time and/or frequency than an in-bundle water-jet lancing according to a different one of the plurality of alternative heat-exchanger remediation strategies.

According to one or more of these embodiments, at least one of the plurality of alternative heat-exchanger remediation strategies includes at least one of the following options for remedying one or more heat-exchanger degradation modes: changing the primary fluid temperature; changing a secondary plant structure such as a turbine; changing a valve; implementing a feedwater heater bypass configuration at a time that differs from an implementation of a feedwater heater bypass configuration according to a different one of the plurality of alternative heat-transfer fouling remediation strategies; replacing the heat exchanger at one or more predetermined times; replacing the heat exchanger at a time that differs from a time of replacement of the heat exchanger according to a different one of the plurality of alternative heat-exchanger remediation strategies; changing the secondary water chemistry; and combinations thereof.

According to one or more of these embodiments, at least one of the plurality of alternative heat-exchanger remediation strategies includes implementing a thermal power uprate (with or without physical changes to the plant configuration) to increase plant electrical power output.

According to one or more of these embodiments, the financial metrics include one or more of the following: net-present-value (NPV) cost, payback period, and internal rate of return.

According to one or more of these embodiments, the time-varying predicted future progressions of heat exchanger performance metrics and/or financial metrics include predicted metrics for different probabilities of occurrence.

According to one or more of these embodiments, the method also includes receiving or calculating a time-varying predicted future progression of heat exchanger performance metrics for a first alternative heat-exchanger remediation strategy that includes replacing the heat exchanger at a first time; receiving or calculating a time-varying predicted future progression of financial metrics describing the accumulated financial benefit of the first alternative heat-exchanger remediation strategy; receiving or calculating a time-varying predicted future progression of heat exchanger performance metrics for a second alternative heat-exchanger remediation strategy that includes replacing the heat exchanger at a second time that differs from the first time; and receiving or calculating a time-varying predicted future progression of financial metrics describing the accumulated financial benefit of the second alternative heat-exchanger remediation strategy.

According to one or more of these embodiments, the time-varying predicted future progression of financial metrics for the first and second alternative heat-exchanger remediation strategies each include one or more of the following: net-present-value (NPV) cost, payback period, and internal rate of return.

According to one or more of these embodiments, the method also includes receiving or calculating an optimal time for replacing the heat exchanger, the optimal time being a time at which replacement of the heat exchanger is predicted to have a more attractive financial metric value (in terms of one or more of: net-present-value cost, payback period, and internal rate of return) and/or a more attractive heat-exchanger performance metric value (in terms of one or more of: secondary operating pressure, heat-transfer efficiency, fraction of defective components within the heat exchanger, and electrical power output) than all other such strategies that include heat exchanger replacement at alternative times.

According to one or more of these embodiments, the heat exchanger includes a heat exchanger of a nuclear power plant.

According to one or more of these embodiments, the calculating of probabilistic time-varying predicted future progressions of heat exchanger performance metrics and/or financial metrics includes one or more of the following: a cost of a deposit removal/remediation application; a duration of outage extensions required to accommodate a deposit removal/remediation application; a duration of outage extensions required to accommodate a tube repair; a duration of outage extensions required to accommodate heat exchanger replacement; a cost of replacement power; an average future concentration of impurities such as iron oxide in the feedwater; a future progression of the thermal resistance of tube scale deposits on the heat-exchanger U-tube outer surfaces; an effect of a deposit removal/remediation strategy on heat-exchanger heat-transfer efficiency; and a difference between an estimated clean thermal resistance of the heat exchanger and an actual value for thermal resistance of the heat exchanger.

According to one or more of these embodiments, the calculating of time-varying predicted future progressions of financial metrics includes calculating the financial metrics on a relative pair-wise basis for one or more pairs of the plurality of alternative heat-exchanger remediation strategies.

According to one or more of these embodiments, the calculating of time-varying predicted future progressions of financial metrics includes calculating time-varying predicted future progressions of financial metrics based, at least in part, on predictions of forced outages associated with operating the plant according to each of the plurality of alternative heat-exchanger remediation strategies.

According to one or more of these embodiments, the calculating of time-varying predicted future progressions of financial metrics includes calculating time-varying predicted future progressions of financial metrics based, at least in part, on predictions of mid-cycle outages associated with operating the plant according to each of the plurality of alternative heat-exchanger remediation strategies.

According to one or more of these embodiments, the calculating of time-varying predicted future progressions of financial metrics includes calculating time-varying predicted future progressions of financial metrics based, at least in part, on different power plant lifetimes.

According to one or more of these embodiments, the calculating of time-varying predicted future progressions of financial metrics includes calculating the financial metrics based, at least in part, on one or more of the following: plant output reductions caused by heat-exchanger tube deposit heat-transfer fouling and corrosion- and wear-induced defects in heat-exchanger tubes; routine tube inspections required to detect tube defects, including changes in such inspections and their costs associated with the type and number of previously detected defects; tube repairs by plugging and/or sleeving; deposit removal/remediation applications, including full-height and partial-height chemical cleaning, dilute chemical applications, top-of-tubesheet water-jet lancing, in-bundle water-jet lancing, ultrasonic energy cleaning, and polymeric dispersant addition; repair or replacement of primary moisture separator components due to material degradation; heat exchanger replacement; extensions to plant outages due to one or more deposit removal/remediation applications; extensions to plant outages due to one or more primary separator component repairs; extensions to plant outages due to one or more tube inspections; extensions to plant outages due to one or more tube repairs; and extensions to plant outages due to one or more heat exchanger replacements.

According to one or more of these embodiments, at least one of the plurality of alternative heat-exchanger remediation strategies includes at least one of the following options for remedying one or more heat-exchanger degradation modes: changing the primary fluid temperature; changing a secondary plant structure such as a turbine; changing a valve; implementing a feedwater heater bypass configuration at a time that differs from an implementation of a feedwater heater bypass configuration according to a different one of the plurality of alternative heat-transfer fouling remediation strategies; replacing the heat exchanger at one or more predetermined times; replacing the heat exchanger at a time that differs from a time of replacement of the heat exchanger according to a different one of the plurality of alternative heat-exchanger remediation strategies; changing the secondary water chemistry; and combinations thereof.

One or more embodiments provides a method for evaluating the progression of heat-exchanger tube deposit heat-transfer fouling in the context of a series of alternative heat-transfer fouling remediation strategies. The method includes for each of a plurality of the alternative heat-transfer fouling remediation strategies, receiving calculated probabilities (and/or calculating the probabilities) that routine, post-outage heat-transfer performance transients that affect the heat exchanger will result in plant thermal power reductions over a specified time period. The method also includes receiving calculated (and/or calculating) accumulated quantities of lost plant production associated with such thermal power reductions calculated over the specified time period.

According to one or more of these embodiments, the method also includes selecting and implementing one of the plurality of alternative heat-transfer fouling remediation strategies based on the received calculated probability and received calculated accumulated quantity of lost plant production.

According to one or more of these embodiments, at least one of the plurality of alternative heat-transfer fouling remediation strategies includes at least one of the following: full-height chemical cleaning at a specific time, full-height chemical cleaning at a different time than for a full-height chemical cleaning according to a different one of the plurality of alternative heat-transfer fouling remediation strategies, partial-height chemical cleaning at a specific time, partial-height chemical cleaning at a different time than for a partial-height chemical cleaning according to a different one of the plurality of alternative heat-transfer fouling remediation strategies, at least one dilute chemical application at a different time and/or frequency than a dilute chemical application according to a different one of the plurality of alternative heat-transfer fouling remediation strategies, at least one tube sheet sludge lancing at a different time and/or frequency than a tube sheet sludge lancing according to a different one of the plurality of alternative heat-transfer fouling remediation strategies, at least one in-bundle water-jet lancing at a different time and/or frequency than an in-bundle water-jet lancing according to a different one of the plurality of alternative heat-transfer fouling remediation strategies, at least one tube bundle flush at a different time and/or frequency than a tube bundle flush according to a different one of the plurality of alternative heat-transfer fouling remediation strategies, at least one ultrasonic energy cleaning at a different time and/or frequency than an ultrasonic energy cleaning according to a different one of the plurality of alternative heat-transfer fouling remediation strategies, polymeric dispersant addition, secondary water chemistry changes, and combinations thereof.

One or more embodiments of the invention may be applied to a single heat exchanger. Alternatively, one or more embodiments may be applied to a heat exchanger system that includes a plurality of heat exchangers of the power plant (e.g., 2 heat exchangers, 4 heat exchangers). Moreover, various of the remediation strategies may include different combinations of options for different ones of the heat exchangers (e.g., chemical cleaning of a first heat exchanger at a first time, and chemical cleaning of a second heat exchanger at a second time)—or they may include the same combinations of options for all heat exchangers analyzed with the invention. As used herein, a heat exchanger may be a single heat exchanger unit or a heat exchanger system that includes multiple heat exchanger units.

According to one or more embodiments, the calculating of time-varying predicted future progressions of heat exchanger performance metrics and/or financial metrics includes calculating time-varying predicted future progressions in probabilistic terms using statistical distributions, rather than fixed values, for at least one calculation input.

One or more embodiments may provide a probabilistic algorithm for evaluating the probability of, and the consequences to plant and financial metrics as described in earlier paragraphs of: a) required ("forced") outages arising from unexpected tube structural defects and/or leakage, and/or b) "mid-cycle outages" required by anticipated excessive and/or severe tube corrosion and/or wear that prevent safe operation for a normal plant operating cycle in the context of alternative heat-exchanger repair and remediation strategies as described in preceding paragraphs.

One or more embodiments may provide a probabilistic algorithm for evaluating the operating lifetime of the plant in which the heat exchangers are installed through calculation of plant and financial metrics as described in earlier paragraphs in the context of alternative heat-exchanger repair and remediation strategies as described in preceding paragraphs. Such evaluation may include assessment of different candidate plant lifetimes (e.g., that associated with a plant license renewal) as well as determination of an optimal plant lifetime according to specified plant or financial metrics.

These and other aspects of various embodiments of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the invention, the structural components illustrated herein are drawn to scale. It is to be expressly understood, however, that the drawings are for the purpose of illustration and description only and are not intended as a definition of the limits of the invention. In addition, it should be appreciated that structural features shown or described in any one embodiment herein can be used in other embodiments as well. As used in the specification and in the claims, the singular form of "a", "an", and "the" include plural referents unless the context clearly dictates otherwise.

BRIEF DESCRIPTION OF THE DRAWINGS

Example embodiments of the methods that may be utilized in practicing the invention are addressed more fully below with reference to the attached drawings in which.

It should be noted that these figures are intended to illustrate the general characteristics of methods with reference to certain example embodiments of the invention and thereby supplement the detailed written description provided below. These drawings are not, however, to scale according to various embodiments, and should not be interpreted as defining or limiting the range of values or properties of embodiments within the scope of this invention. To the contrary, the principles of the present invention are intended to encompass any and all changes, alterations and/or substitutions within the spirit and scope of the following claims.

DETAILED DESCRIPTION OF EXEMPLARY EMBODIMENTS OF THE INVENTION

An embodiment of the current invention includes computer-executable instructions (e.g., computer code) that implement an algorithm capable of calculating, with a probabilistic method, time-varying quantities relevant to: a) important plant metrics such as heat-exchanger steam pressure, plant power output (e.g., electrical output as measured, e.g., with MWe), and fraction of in-service heat-exchanger U-tubes, among others, and b) the NPV costs associated with alternative heat-exchanger remediation strategies that include options for addressing individual heat-exchanger degradation modes. Included below are specific examples of embodiments of the invention.

The computer code may be tangibly stored on any suitable electronic storage or computer-readable storage medium (e.g., RAM, ROM, flash, microchip, hard disk drive, solid state drive, etc.) of any suitable computer (e.g., PC, laptop, server computing device, client computing device) running any suitable operating system (e.g., Windows, Unix, Linux, etc.) and including any suitable processor or processors.

Example embodiments of the invention include a computer code capable of evaluating and comparing alternative strategies that include individual options for remedying multiple interdependent heat-exchanger degradation modes such as tube deposit heat-transfer fouling, tube corrosion and wear, tube support plate broached hole blockage, and moisture separator component material degradation, among others. One hypothetical example of such a strategy (among many others) is the following set of options taken together:

a) application of a dilute chemical treatment at regular intervals to remove a portion of the tube deposits; b) an increase, of a predetermined magnitude, in the primary fluid temperature; c) use of sleeves to repair corrosion defects at the tube sheet elevation; d) implementation of a thermal power uprate of a predetermined magnitude; and e) replacement of the steam generators at a predetermined time. In this example embodiment, the option for deposit removal in the selected strategy ("a" above) is compared against a control option that comprises operating the steam generator without any removal of tube deposits.

Figure 1:
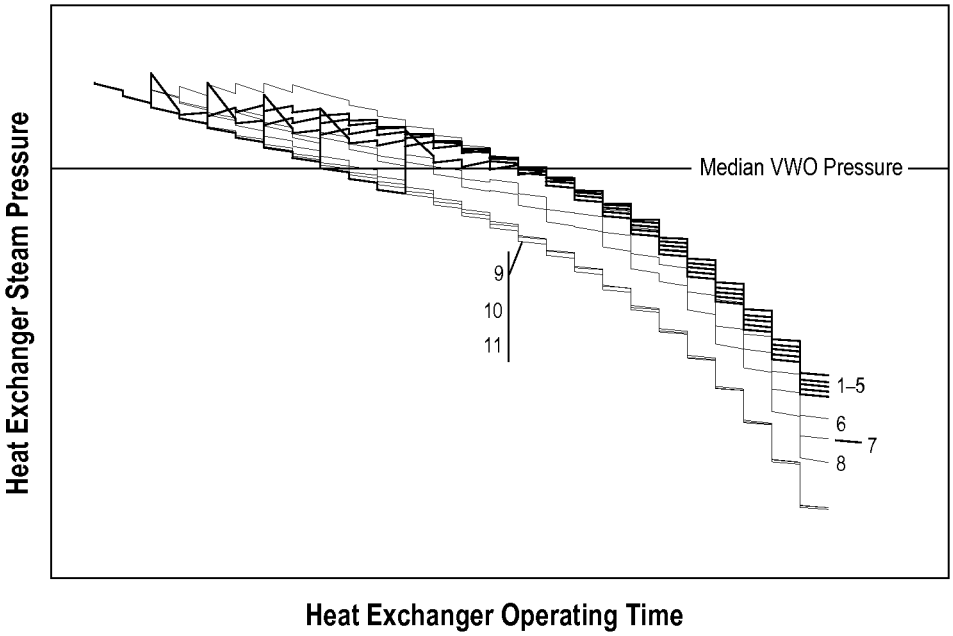
FIG. 1 illustrates an example of predicted future steam generator steam pressure values for a set of 11 hypothetical alternative heat-exchanger remediation strategies according to an example embodiment of the invention.
Figure 2:
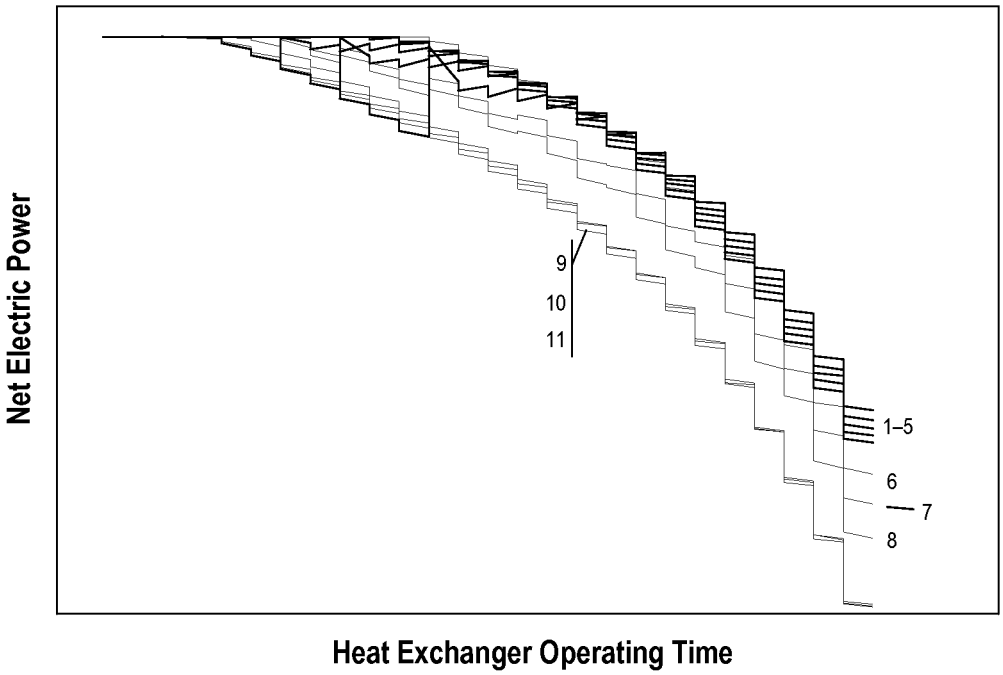
FIG. 2 illustrates an example of predicted future plant electrical output values for a set of 11 hypothetical alternative heat-exchanger remediation strategies according to an example embodiment of the invention.

Embodiments of the invention include, for example, an algorithm that predicts for all alternative strategies evaluated the time variation of important plant metrics, including, among others: a) heat-exchanger steam pressure, an example of which is shown in FIG. 1; b) plant production as measured, e.g., by electrical megawatts (MWe), an example of which is shown in FIG. 2; c) fraction of total heat-exchanger U-tubes experiencing service-induced defects; and d) average fraction of tube support plate broached hole flow area blocked by deposits.

Figure 3:
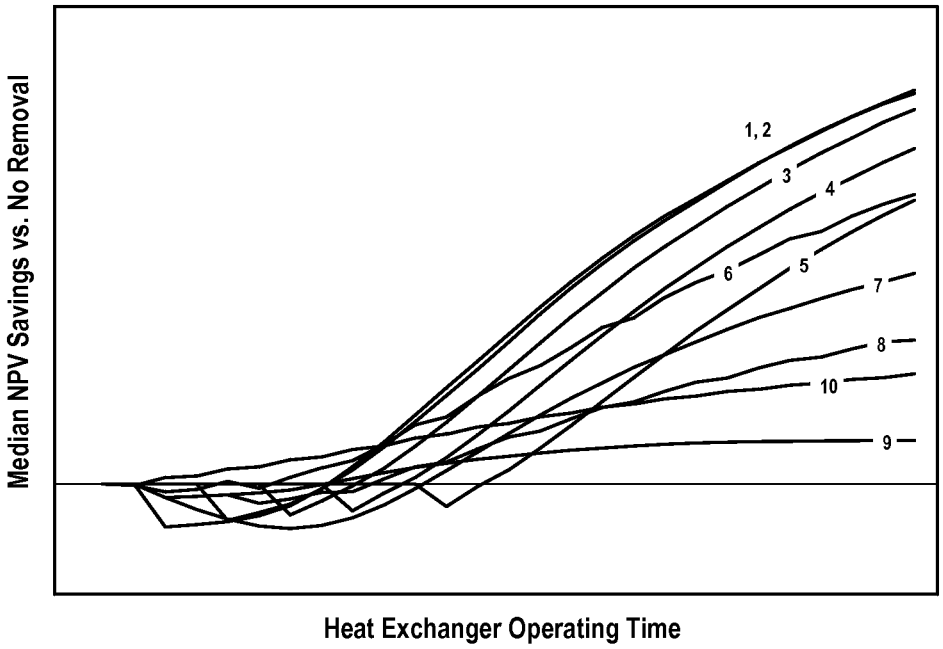
FIG. 3 illustrates an example of the median net-present-value (NPV) savings associated with 10 different alternative heat-exchanger remediation strategies, compared to the cost of a "control" strategy (or "baseline alternative"), calculated according to an example embodiment of the invention.

Embodiments also include, for example, a computer code that predicts the time-varying NPV cost incurred for all alternative strategies evaluated, where these costs include the costs due to the following causes, among others: a) plant output reductions (decreases in MWe) caused by tube deposit heat-transfer fouling and corrosion- and wear-induced tube defects; b) routine tube inspections required to detect tube defects, including changes in such inspections (and their costs) associated with the type and number of defective tubes detected previously; c) tube repairs by plugging and/or sleeving; d) deposit removal/remediation applications, including chemical cleaning (either through treatment of the entire tube bundle or through treatment of the top-of-tube-sheet region only), dilute chemical applications, top-of-tubesheet water-jet lancing, in-bundle water-jet lancing, ultrasonic energy cleaning, and polymeric dispersant addition, among others; e) repair or replacement of primary separator components due to material degradation; f) steam generator replacement; and g) extensions to plant outages due to, e.g., deposit removal/remediation applications, primary separator component repairs, tube repairs, and steam generator replacement. An example of these costs for 10 alternative deposit removal/remediation strategies, less the same costs for a "control" strategy, as calculated by an embodiment of the invention is shown in FIG. 3.

Embodiments include, for example, a computer code that makes the predictions using a probabilistic method, such as a Monte Carlo method, to calculate results with different probabilities of occurrence. For example, there is a predicted probability of 50% that an actual future result (such as an NPV cost for a given strategy) will be larger than the median (or $50^{th}$ percentile) result predicted with a probabilistic method. Similarly, there is a predicted probability of 25% that an actual future result will be larger than the $75^{th}$ percentile result predicted with a probabilistic method. Such calculated probabilistic results provide the owner of the heat exchanger with a quantitative understanding of how input uncertainties may affect the actual outcomes (e.g., total NPV cost, secondary steam pressure, plant output, etc.) associated with the alternative remediation strategies evaluated. This is a significant extension beyond the prior art, which produces best-estimate results and/or bounding results with an unquantified probability of occurrence. Examples of $50^{th}$ percentile results calculated according to an example embodiment are shown in FIG. 3.

Figure 6:
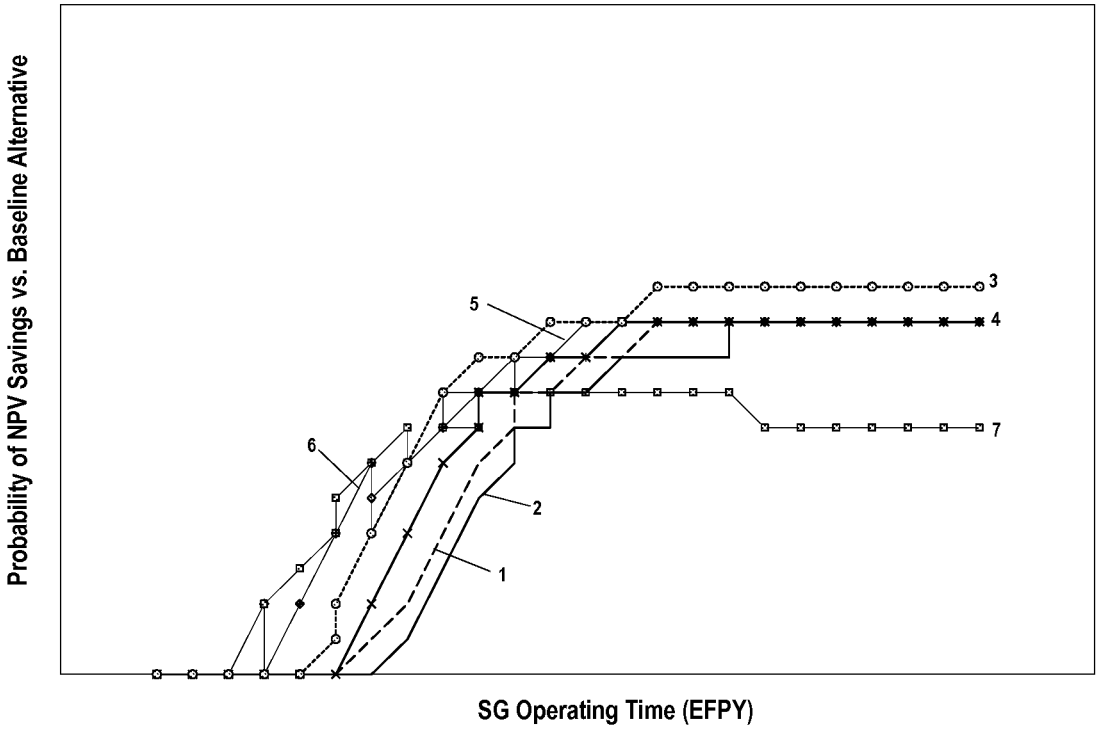
FIG. 6 illustrates an example of the predicted probability that individual heat-exchanger remediation strategies will result in lower NPV costs than a baseline alternative heat-exchanger remediation strategy as calculated by an embodiment of the invention.

Embodiments include, for example, a computer code which yields direct, pair-wise probabilistic comparisons of NPV costs for alternative strategies, thereby providing calculated probabilities that one strategy will be less costly than another. Examples of such pair-wise comparisons as calculated by an example embodiment of the invention are illustrated by the curves in FIG. 3 and also by the curves in FIG. 6, which show the calculated probability that individual separately numbered strategies will be less costly than a baseline alternative ("control") strategy.

Example embodiments include a computer code capable of predicting for all alternative strategies the probability that, for example: a) reductions in plant output larger than a specified magnitude will occur, b) remedial measures such as chemical cleaning or dilute chemical treatment will be required to reduce the degree of tube support plate broached hole blockage caused by deposits to restore plant operability, and c) moisture separator component material degradation will be severe enough to require remediation.

Figure 7:
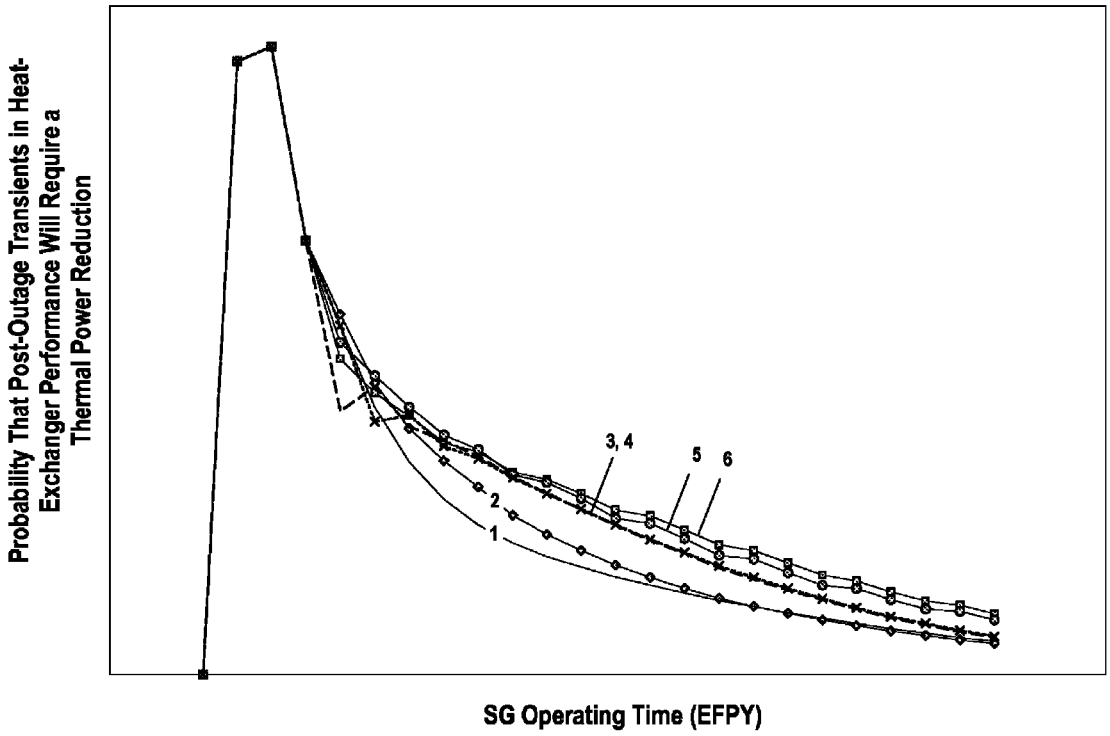
FIG. 7 illustrates an example of the predicted probability that post-outage heat-exchanger performance transients will require a thermal power reduction that would not otherwise have been necessary, as calculated by an embodiment of the invention.

Example embodiments include a computer code capable of predicting the time-varying probability that commonly observed post-outage transients in steam generator heat-transfer efficiency will require a reduction in the plant thermal power level. An example of such results calculated with an embodiment of the invention is shown in FIG. 7.

Example embodiments include a computer code that performs the calculations and predictions for the situation in which the heat-exchangers are replaced at a specified future time. In this example embodiment, the costs of heat-exchanger replacement, including vendor cost and the lost plant production associated with the necessary plant outage that accommodates the heat-exchanger replacement, are incorporated into the algorithm's calculations.

Example embodiments also include a computer code that performs the calculations and predictions for the situation in which a plant thermal power uprate is implemented. In this example embodiment, the costs associated with the uprate (such as modifications to plant equipment among others) and the quantity and value of the additional plant production achieved with the power uprate are incorporated into the algorithm's calculations.

Figure 4:
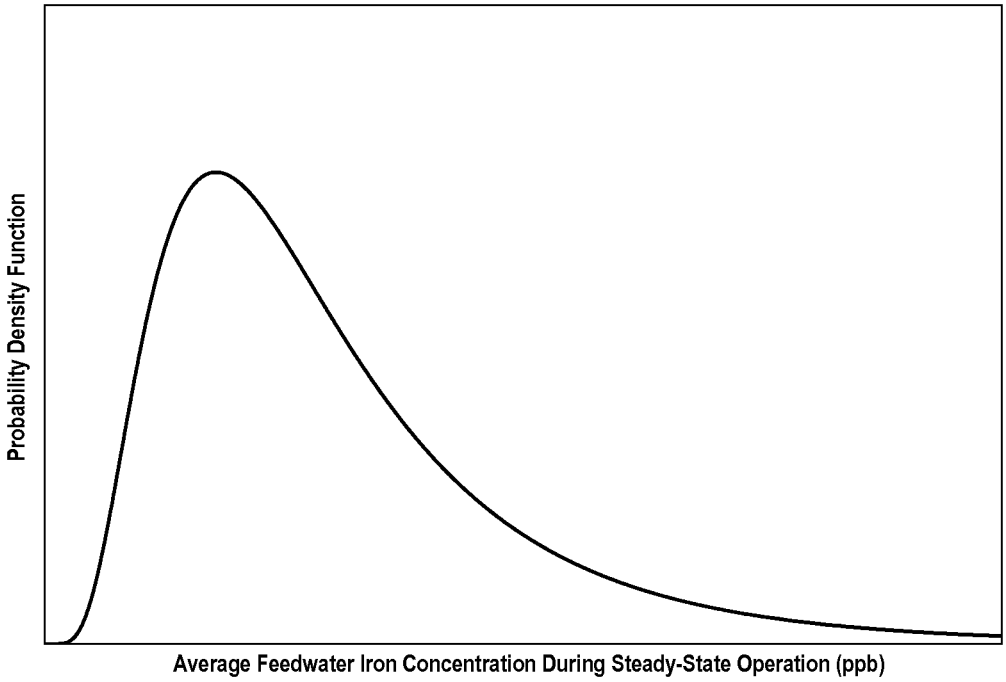
FIG. 4 illustrates an example of a statistical distribution used as an input for calculating probabilistic results according to an example embodiment of the invention.
Figure 5:
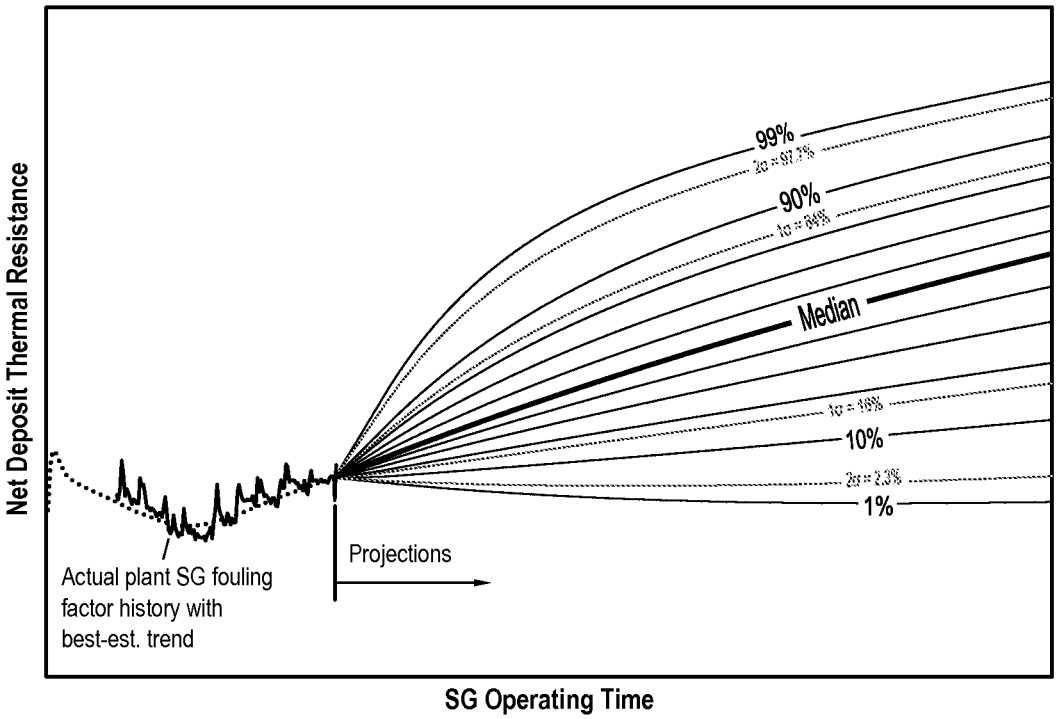
FIG. 5 illustrates an example of a predicted future progression of steam generator tube deposit thermal resistance (including probabilistic results for various probabilities of occurrence) according to an example embodiment of the invention.

Example embodiments include a computer code that performs its probabilistic calculations with statistical distributions (including continuous distributions), rather than fixed values or limited sets of fixed values, for important calculation inputs such as, for example: a) the cost of deposit removal/remediation applications; b) the duration of outage extensions required to accommodate such applications, to accommodate necessary tube repairs, or to accommodate heat-exchanger replacement, for example; c) the cost of replacement power; the average future concentration of impurities such as iron oxide in the feedwater, an example of which is shown in FIG. 4; d) the future progression of the thermal resistance of tube scale deposits on the U-tube outer surfaces, an example of which is shown in FIG. 5; e) the effects of deposit removal/remediation strategies on heat-exchanger heat-transfer efficiency; and f) the difference between the estimated clean thermal resistance of the heat-exchangers and the actual value for this parameter. Use of statistical distributions as inputs to calculations performed with probabilistic methods permits simultaneous quantitative evaluation of the effects of uncertainties in all such inputs on the computed results.

The foregoing illustrated embodiments are provided to illustrate the structural and functional principles of the present invention and are not intended to be limiting. To the contrary, the principles of the present invention are intended to encompass any and all changes, alterations and/or substitutions within the spirit and scope of the invention.

We claim:

1. A method for evaluating simultaneously the effects of multiple, interdependent heat-exchanger degradation modes for a heat exchanger of a power plant in the context of a series of alternative heat-exchanger remediation strategies that include individual options for remedying one or more of the degradation modes, the method comprising:

receiving probabilistic time-varying predicted future progressions of heat exchanger performance metrics for a plurality of alternative heat-exchanger remediation strategies, wherein the probabilistic time-varying predicted future progressions are based on a single, integrated probabilistic analysis of the effects of multiple, interdependent heat-exchanger degradation modes, the performance metrics including:

a secondary side operating pressure of the heat exchanger, a heat-transfer efficiency of the heat exchanger, a fraction of defective components within the heat exchanger that are subject to one or more heat-exchanger degradation modes, and an electrical power output of the plant;

receiving probabilistic time-varying predicted future progressions of financial metrics describing the accumulated financial benefit of each of the plurality of alternative heat-exchanger remediation strategies; and selecting and implementing one of the plurality of alternative heat-exchanger remediation strategies based on the received probabilistic time-varying predicted future progressions of the heat exchanger performance metrics, wherein the time-varying predicted future progressions of heat-exchanger performance metrics for a plurality of alternative heat-exchanger remediation strategies account for routine post-outage heat-transfer transients that result from operating the plant in accordance with each of the plurality of alternative heat-exchanger remediation strategies, and wherein implementing the selected one of the plurality of alternative heat-exchanger remediation strategies includes performing at least one of the following acts:

chemical cleaning, applying at least one dilute chemical, lancing tube sheet sludge, in-bundle water-jet lancing, tube bundle flushing, ultrasonic energy cleaning, adding a polymeric dispersant, changing secondary water chemistry, repairing a defective heat-exchanger tube by plugging, repairing a defective heat-exchanger tube by sleeving, lowering a primary fluid temperature, repairing at least one tube moisture separator component; or replacing at least one tube moisture separator component.

2. The method of claim 1, wherein:

one of the plurality of alternative heat-exchanger remediation strategies includes a modification of a valve of a high-pressure turbine of the power plant, wherein the turbine is operatively connected to the heat exchanger; and another of the plurality of alternative heat-exchanger remediation strategies does not include the modification of the valve.

3. The method of claim 1, wherein:

one of the plurality of alternative heat-exchanger remediation strategies includes an implementation of a feedwater heater bypass configuration; and another of the plurality of alternative heat-exchanger remediation strategies does not include an implementation of a feedwater heater bypass configuration.

4. The method of claim 1, wherein:

one of the plurality of alternative heat-exchanger remediation strategies includes a change to the chemistry of water in the secondary plant system; and another of the plurality of alternative heat-exchanger remediation strategies does not include a change to the chemistry of water in the secondary plant system.

5. The method of claim 1, wherein one of the plurality of alternative heat-exchanger remediation strategies includes adding zinc to a primary coolant associated with the heat exchanger, and wherein the time-varying predicted future progression of heat-exchanger performance metrics for the one of the plurality of alternative heat-exchanger remediation strategies accounts for one or more effects of an addition of zinc to the primary coolant.

6. The method of claim 1, wherein the financial metrics account for forced outages associated with the plurality of alternative heat-exchanger remediation strategies.

7. The method of claim 1, wherein the financial metrics account for mid-cycle outages associated with the plurality of alternative heat-exchanger remediation strategies.

8. The method of claim 1, further comprising selecting and implementing one of the plurality of alternative heat-exchanger remediation strategies based on the received time-varying predicted future progressions of financial metrics.

9. The method of claim 1, wherein at least one of the plurality of alternative heat-exchanger remediation strategies includes at least one of the following options for remedying tube deposit heat-transfer fouling:

full-height chemical cleaning at at least one specific time and/or frequency, full-height chemical cleaning at a different time and/or frequency than a full-height chemical cleaning according to a different one of the plurality of alternative heat-exchanger remediation strategies, partial-height chemical cleaning at at least one specific time and/or frequency, partial-height chemical cleaning at a different time and/or frequency than a partial-height chemical cleaning according to a different one of the plurality of alternative heat-exchanger remediation strategies, at least one dilute chemical application at at least one specific time and/or frequency, at least one dilute chemical application at a different time and/or frequency than at least one dilute chemical application according to a different one of the plurality of alternative heat-exchanger remediation strategies, tube sheet sludge lancing at at least one specific time and/or frequency, tube sheet sludge lancing at a different time and/or frequency than a tube sheet sludge lancing according to a different one of the plurality of alternative heat-exchanger remediation strategies, in-bundle water jet lancing at at least one specific time and/or frequency, in-bundle water jet lancing at a different time and/or frequency than an in-bundle water-jet lancing according to a different one of the plurality of alternative heat-exchanger remediation strategies, tube bundle flushing at at least one specific time and/or frequency, tube bundle flushing at a different time and/or frequency than a tube bundle flushing according to a different one of the plurality of alternative heat-exchanger remediation strategies, ultrasonic energy cleaning at at least one specific time and/or frequency, ultrasonic energy cleaning at a different time and/or frequency than an ultrasonic energy cleaning according to a different one of the plurality of alternative heat-exchanger remediation strategies, polymeric dispersant addition, other secondary water chemistry changes, and combinations thereof.

10. The method of claim 1, wherein at least one of the plurality of alternative heat-exchanger remediation strategies includes at least one of the following options for remedying heat-exchanger tube corrosion and wear degradation:

repairing defective heat-exchanger tubes by plugging, repairing defective heat-exchanger tubes by sleeving, reducing the rate of future occurrence of degraded tubes by lowering the primary fluid temperature, implementing a full-height chemical cleaning at one or more specific times, implementing a full-height chemical cleaning at a different specific time than a full-height chemical cleaning according to a different one of the plurality of alternative heat-exchanger remediation strategies, implementing a partial-height chemical cleaning at a specific time, implementing a partial-height chemical cleaning at a different specific time than a partial-height chemical cleaning according to a different one of the plurality of alternative heat-exchanger remediation strategies, and combinations thereof.

11. The method of claim 1, wherein at least one of the plurality of alternative heat-exchanger remediation strategies includes at least one of the following options for remedying tube support plate broached hole blockage:

implementing a full-height chemical cleaning at one or more specific times, implementing a full-height chemical cleaning at a different specific time than a full-height chemical cleaning according to a different one of the plurality of alternative heat-exchanger remediation strategies, implementing at least one dilute chemical application at at least one specific time and/or frequency, implementing at least one dilute chemical application at a different time and/or frequency than a dilute chemical application according to a different one of the plurality of alternative heat-exchanger remediation strategies, in-bundle water-jet lancing at at least one specific time and/or frequency, and in-bundle water-jet lancing at a different time and/or frequency than an in-bundle water-jet lancing according to a different one of the plurality of alternative heat-exchanger remediation strategies.

12. The method of claim 1, wherein at least one of the plurality of alternative heat-exchanger remediation strategies includes at least one of the following options for remedying tube support plate material degradation:

implementing a full-height chemical cleaning at one or more specific times, implementing a full-height chemical cleaning at a different specific time than a full-height chemical cleaning according to a different one of the plurality of alternative heat-exchanger remediation strategies, implementing a partial-height chemical cleaning at a specific time, implementing a partial-height chemical cleaning at a different specific time than a partial-height chemical cleaning according to a different one of the plurality of alternative heat-exchanger remediation strategies, implementing at least one dilute chemical application at at least one specific time and/or frequency, implementing at least one dilute chemical application at a different time and/or frequency than a dilute chemical application according to a different one of the plurality of alternative heat-exchanger remediation strategies, in-bundle water-jet lancing at at least one specific time and/or frequency, and in-bundle water-jet lancing at a different time and/or frequency than an in-bundle water-jet lancing according to a different one of the plurality of alternative heat-exchanger remediation strategies.

13. The method of claim 1, wherein at least one of the plurality of alternative heat-exchanger remediation strategies includes at least one of the following options for remedying tube moisture separator component material degradation:

weld repairs, separator component replacement, at least one chemical cleaning at a different time and/or frequency than a chemical cleaning according to a different one of the plurality of alternative heat-exchanger remediation strategies, and at least one in-bundle water-jet lancing at a different time and/or frequency than an in-bundle water jet lancing according to a different one of the plurality of alternative heat-exchanger remediation strategies.

14. The method of claim 1, wherein at least one of the plurality of alternative heat-exchanger remediation strategies includes at least one of the following options for remedying one or more heat-exchanger degradation modes:

changing the primary fluid temperature;

changing a secondary plant structure such as a turbine;

changing a valve;

implementing a feedwater heater bypass configuration at a time that differs from an implementation of a feedwater heater bypass configuration according to a different one of the plurality of alternative heat-exchanger remediation strategies;

replacing the heat exchanger at one or more predetermined times;

replacing the heat exchanger at a time that differs from a time of replacement of the heat exchanger according to a different one of the plurality of alternative heat-exchanger remediation strategies;

changing the secondary water chemistry; and combinations thereof.

15. The method of claim 1, wherein at least one of the plurality of alternative heat-exchanger remediation strategies includes implementing a thermal power uprate to increase plant electrical power output.

16. The method of claim 1, wherein the time-varying predicted future progressions of heat exchanger performance metrics include predicted metrics for different probabilities of occurrence.

17. The method of claim 1, wherein the time-varying predicted future progressions of financial metrics include predicted metrics for different probabilities of occurrence.

18. The method of claim 1, further comprising:

receiving a time-varying predicted future progression of heat exchanger performance metrics for a first alternative heat-exchanger remediation strategy that includes replacing the heat exchanger at a first time;

receiving a time-varying predicted future progression of financial metrics describing the accumulated financial benefit of the first alternative heat-exchanger remediation strategy;

receiving a time-varying predicted future progression of heat exchanger performance metrics for a second alternative heat-exchanger remediation strategy that includes replacing the heat exchanger at a second time that differs from the first time; and receiving a time-varying predicted future progression of financial metrics describing the accumulated financial benefit of the second alternative heat-exchanger remediation strategy.

19. The method of claim 1, wherein the heat exchanger comprises a heat exchanger of a nuclear power plant.

20. The method of claim 1, wherein the receiving of time-varying predicted future progressions of financial metrics comprises receiving time-varying predicted future progressions of financial metrics based, at least in part, on different power plant lifetimes.

21. The method of claim 1, wherein the evaluation of the effects of multiple, interdependent heat-exchanger degradation modes comprises an evaluation of at least two of the following degradation modes:

tube deposit heat-transfer fouling, tube corrosion and wear, support plate broached hole blockage, tube support plate material degradation, and moisture separator component material degradation.

22. The method of claim 1, wherein said implementing one of the plurality of alternative heat-exchanger remediation strategies includes performing at least one of the following acts:

remedying tube deposit heat-transfer fouling, wherein said remedying of tube deposit heat-transfer fouling includes performing at least one of the following acts: full-height chemical cleaning, partial-height chemical cleaning, at least one dilute chemical application, tube sheet sludge lancing, in-bundle water-jet lancing, tube bundle flushing, ultrasonic energy cleaning, polymeric dispersant addition, and secondary water chemistry changes, remedying heat-exchanger tube corrosion and wear degradation, wherein said remedying of heat-exchanger tube corrosion and wear degradation includes performing at least one of the following acts: repairing defective heat-exchanger tubes by plugging, repairing defective heat-exchanger tubes by sleeving, reducing the rate of future occurrence of degraded tubes by lowering the primary fluid temperature, implementing a full-height chemical cleaning, and implementing a partial-height chemical cleaning, remedying tube support plate broached hole blockage, wherein said remedying of tube support plate broached hole blockage includes performing at least one of the following acts: implementing a full-height chemical cleaning, implementing at least one dilute chemical application, in-bundle water-jet lancing, remedying tube support plate material degradation, wherein said remedying of tube support plate material degradation includes performing at least one of the following acts: implementing a full-height chemical cleaning, implementing a partial-height chemical cleaning, implementing at least one dilute chemical application, in-bundle water jet lancing, and remedying moisture separator component material degradation, wherein said remedying of tube deposit heat-transfer fouling includes performing at least one of the following acts: making weld repairs, replacing a separator component, at least one chemical cleaning, and at least one in-bundle water jet lancing.

23. A computer-implemented method of evaluating simultaneously the effects of multiple, interdependent heat-exchanger degradation modes for a heat exchanger of a power plant in the context of a series of alternative heat-exchanger remediation strategies that include individual options for remedying one or more of the degradation modes, the method being implemented in a computer comprising electronic storage and one or more physical processors configured to execute one or more computer program modules, the method comprising:

calculating probabilistic time-varying predicted future progressions of heat exchanger performance metrics for a plurality of alternative heat-exchanger remediation strategies by evaluating the effects of multiple, interdependent heat-exchanger degradation modes in a single, integrated probabilistic analysis, the performance metrics including:

a secondary side operating pressure of the heat exchanger, a heat-transfer efficiency of the heat exchanger, a fraction of defective components within the heat exchanger that are subject to one or more heat-exchanger degradation modes, and an electrical power output of the plant;

calculating probabilistic time-varying predicted future progressions of financial metrics describing the accumulated financial benefit of each of the plurality of alternative heat-exchanger remediation strategies; and selecting and implementing one of the plurality of alternative heat-exchanger remediation strategies based on the probabilistic time-varying predicted future progressions of the heat exchanger performance metrics, wherein implementing the selected one of the plurality of alternative heat-exchanger remediation strategies includes performing at least one of the following acts:

chemical cleaning, applying at least one dilute chemical, lancing tube sheet sludge, in-bundle water-jet lancing, tube bundle flushing, ultrasonic energy cleaning, adding a polymeric dispersant, changing secondary water chemistry, repairing a defective heat-exchanger tube by plugging, repairing a defective heat-exchanger tube by sleeving, lowering a primary fluid temperature, repairing at least one tube moisture separator component; or replacing at least one tube moisture separator component, wherein the time-varying predicted future progressions of heat-exchanger performance metrics for a plurality of alternative heat-exchanger remediation strategies account for routine post-outage heat-transfer transients that result from operating the plant in accordance with each of the plurality of alternative heat-exchanger remediation strategies.

24. The method of claim 23, wherein evaluating the effects of multiple, interdependent heat-exchanger degradation modes comprises evaluating at least two of the following degradation modes:

tube deposit heat-transfer fouling, tube corrosion and wear, support plate broached hole blockage, tube support plate material degradation, and moisture separator component material degradation.

25. A method for evaluating the progression of heat-exchanger tube deposit heat-transfer fouling in the context of a series of alternative heat-transfer fouling remediation strategies, in a single, integrated probabilistic analysis, the method comprising:

for each of a plurality of the alternative heat-transfer fouling remediation strategies, receiving calculated probabilities that routine, post-outage heat-transfer performance transients that affect the heat exchanger will result in plant thermal power reductions over a specified time period;

receiving calculated accumulated quantities of lost plant production associated with such thermal power reductions calculated over the specified time period; and selecting and implementing one of the plurality of alternative heat-transfer fouling remediation strategies based on the received calculated probability and received calculated accumulated quantity of lost plant production, wherein implementing the selected one of the plurality of alternative heat-exchanger remediation strategies includes performing at least one of the following acts:

chemical cleaning, applying at least one dilute chemical, lancing tube sheet sludge, in-bundle water-jet lancing, tube bundle flushing, ultrasonic energy cleaning, adding a polymeric dispersant, changing secondary water chemistry, repairing a defective heat-exchanger tube by plugging, repairing a defective heat-exchanger tube by sleeving, lowering a primary fluid temperature, repairing at least one tube moisture separator component; or replacing at least one tube moisture separator component.

* * * * *